United States Patent [19]

Kametaki

[11] 4,049,181

[45] Sept. 20, 1977

[54] AUTOMATIC NAILING MACHINE

[76] Inventor: Shigemasa Kametaki, 7225-5 Shingu, Shingu, Wakayama, Japan

[21] Appl. No.: 696,315

[22] Filed: June 15, 1976

[30] Foreign Application Priority Data

Dec. 4, 1975 Japan ..... 50-144866
Mar. 22, 1976 Japan ..... 51-31538

[51] Int. Cl.[2] ..... B25C 1/00
[52] U.S. Cl. ..... 227/113
[58] Field of Search ..... 227/109, 113

[56] References Cited

U.S. PATENT DOCUMENTS

| | | | |
|---|---|---|---|
| 1,539,894 | 6/1925 | Booth | 227/113 |
| 3,022,509 | 2/1962 | DeMan | 227/109 |
| 3,765,588 | 10/1973 | Frederickson | 227/113 |
| 3,820,705 | 6/1974 | Beals | 227/113 |

FOREIGN PATENT DOCUMENTS

| | | | |
|---|---|---|---|
| 2,331,743 | 6/1973 | Germany | 227/113 |

*Primary Examiner*—Granville Y. Custer, Jr.
*Attorney, Agent, or Firm*—Wenderoth, Lind & Ponack

[57] ABSTRACT

Automatic nailing machine provided with a magnetic attraction means on the side wall of the guide hole through which a piston rod driven by compressed air passes during the nailing operation. The machine is constructed so the nail to be driven, supplied to the guide hole from a magazine connected to the guide hole to supply nails thereinto, is held temporarily by said magnetic attraction means before the piston rod lowers and drives the nail.

2 Claims, 12 Drawing Figures

AUTOMATIC NAILING MACHINE

BACKGROUND OF THE INVENTION

The present invention relates to a small-sized automatic nailing machine used for manufacturing packing wooden flasks and the like. The automatic nailing mahcine is constructed so that it supplies nails in the magazine communicated with a guide hole one by one into the guide hole nose located at the tip thereof. The head of each nail in the guide hole is struck by the tip of a piston rod movable in the guide hole toward the opening at the bottom thereof. The piston rod is driven by compressed air when a trigger on the apparatus is pulled. To make it possible to supply the nails charged in the magazine one by one into the guide hole as described above, heretofore various means have been proposed and put in practice, but there were defects; the automatic nailing machines were complicated in construction and poor in durability, or the nails to be driven were applied with special measures (like sticking a plurality of nails at suitably spaced intervals on adhesive tape or the like), thereby increasing costs as well as the consumption of nails.

SUMMARY OF THE INVENTION

The present invention is characterized in that suitable magnetic attraction means is provided in the side wall of said guide hole or at the tip of the piston rod, so that nails slide down from the magazine attached on an incline toward the guide hole under their own weight and are attracted to said attration means. Thereby, the nails are supplied one by one into the guide hole.

An object of this invention is to provide an automatic nailing machine which is simple in construction and highly durable and which can drive nails smoothly and continuously one by one. Another object of this invention is to provide an automatic nailing machine which will use ordinary loose nails (not nails specially prepared such as by sticking them together with adhesive tape as described above) as the nails to be charged into the magazine.

A further object of this invention is to provide an automatic nailing machine having a magazine which is adjustable so that it can hold the loose nails according to the diameter of those nails.

BRIEF DESCRIPTION OF THE DRAWING

Reference will now be made to the accompanying drawing, in which.

DETAILED DESCRIPTION OF THE INVENTION

Figure 1:
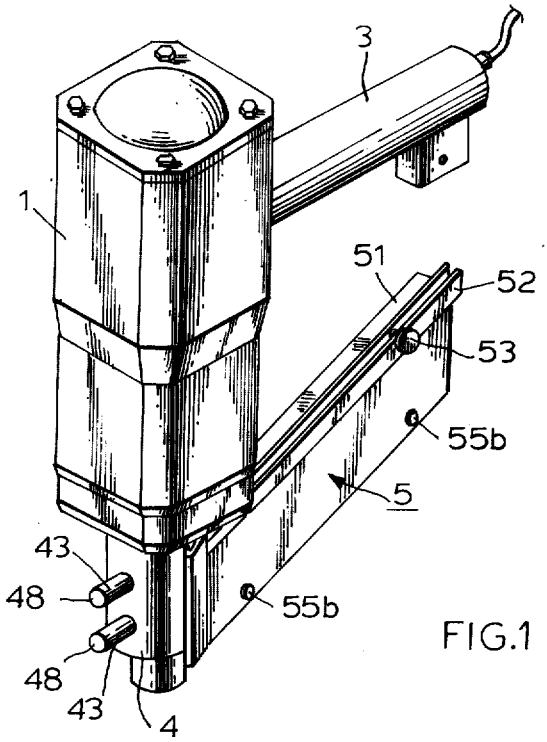
FIG. 1 is an oblique view showing the automatic nailing machine according to the present invention.
Figure 4:
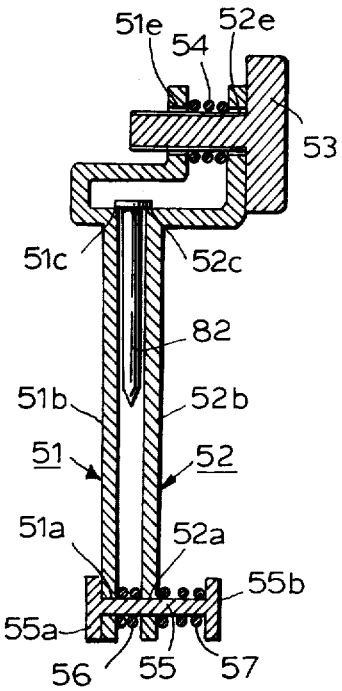
FIG. 4 is a longitudinal section taken along the line A—A in FIG. 3.
Figure 3:
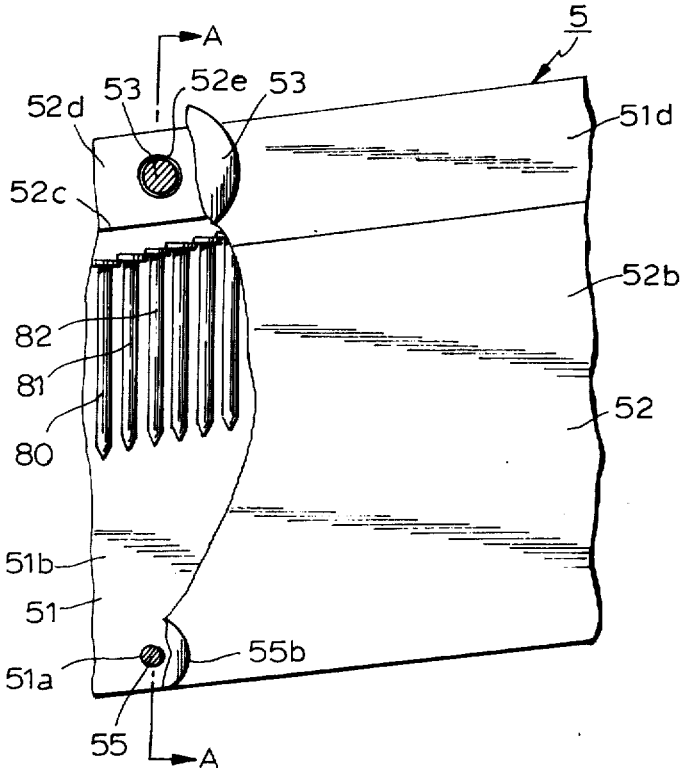
FIG. 3 is a side view, partially sectioned, showing a part of the magazine.
Figure 2:
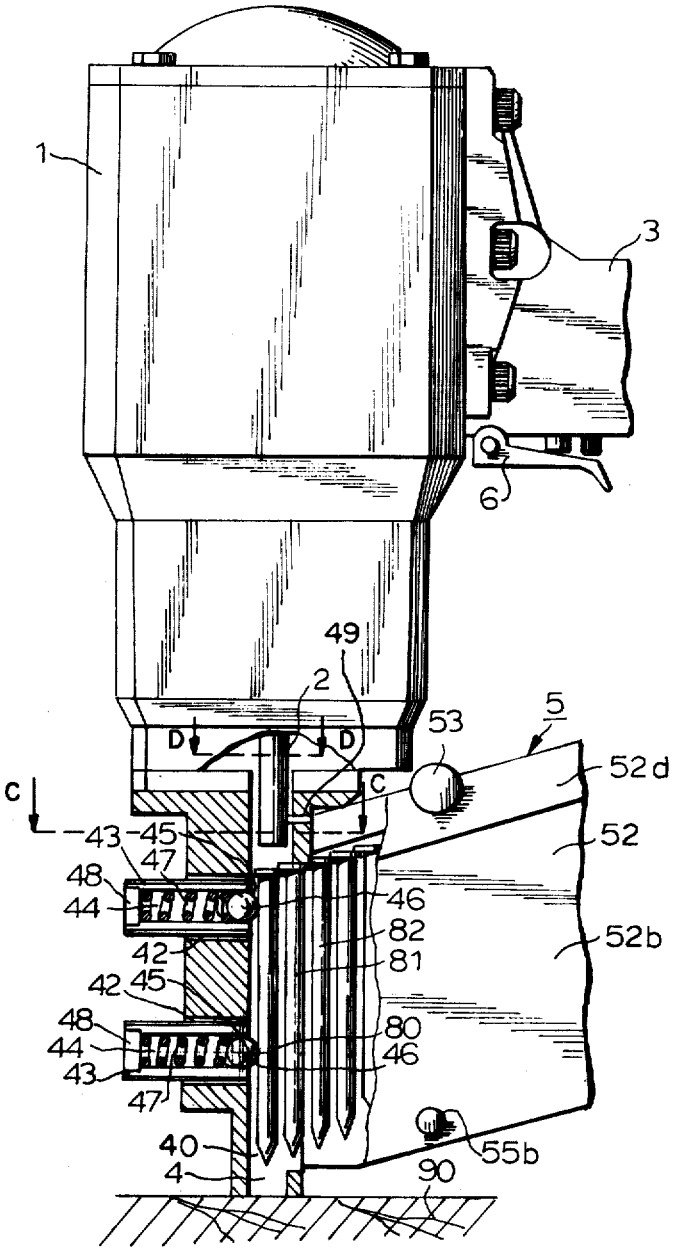
FIG. 2 is a side view, partially sectioned, of the principal part around the nose of automatic nailing machine according to the present invention.

In FIGS. 1 and 2, casing 1 houses a piston rod 2 and has a handle 3 secured to the side thereof. A nose 4 is secured to the lower end of the casing and has in the interior thereof a guide hole 40 through which the piston rod 2 and the nail to be pressed at the head thereof by the piston rod 2 are permitted to pass. A magazine 5 is to be charged with a plurality of nails 80, 81, 82, - - -, and the opening at one side thereof is communicated with the guide hole 40, and is attached at an include to the side of the nose 4 with the side of the guide hole 40 located on the downward side.

The detailed construction of the nose 4 is as follows.

Figure 5:
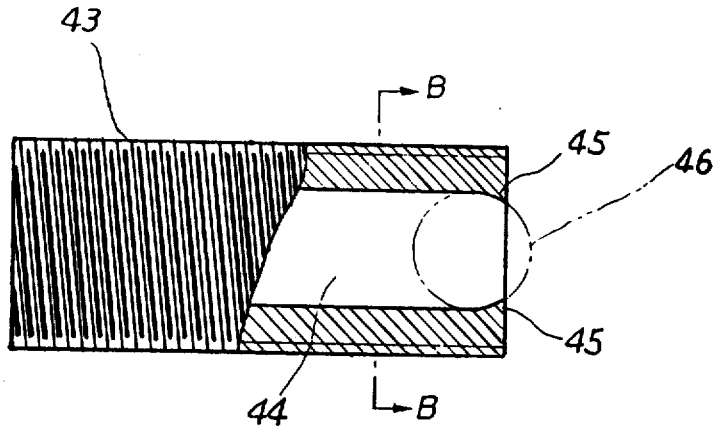
FIG. 5 is a partially sectioned side view of one of the cylindrical bodies at the side of the guide hole.
Figure 6:
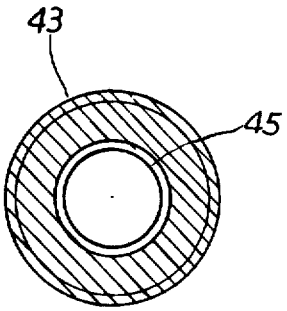
FIG. 6 is a section view of the cylindrical body along the line B—B of FIG. 5.
Figure 7:
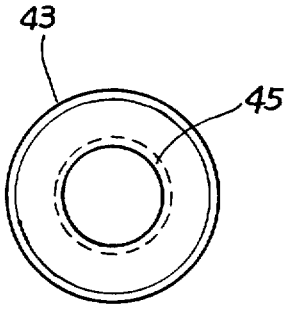
FIG. 7 is a right end view of the cylindrical body in FIG. 5.
Figure 8:
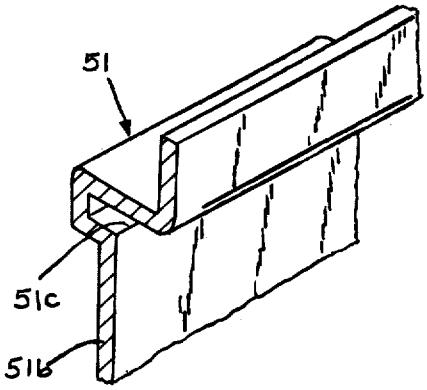
FIG. 8 is a sectional oblique view of one of the side plates.
Figure 9:
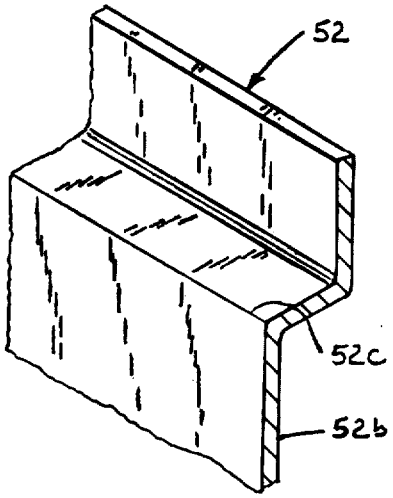
FIG. 9 is a sectional oblique view of the other side plate.

Opposite the open side of the magazine 5 in the side wall 41 of the guide hole 40, two lateral tapped holes 42, 42, spaced vertically at a suitable interval, are nearly at a right angle to the guide hole 40 and are larger in diameter than the guide hole 40. Cylindrical bodies 43, 43 made of stainless steel and threaded on the periphery thereof are screwed in the tapped holes 42, 42, and formed integrally with the cylindrical bodies on the inner peripheries of the end fronting to the guide hole 40 are stoppers 45, 45 (see FIGS. 5 - 7) projecting into the cavities 44, 44 of the cylindrical bodies 43, 43. In each of the cavities 44, 44 is a spherical permanent magnet 46, 46, the dimension of the outer diameter thereof being somewhat smaller than the cavities 44, 44 and approximately the same dimension as the diameter of the guide hole 40. Coil springs 47, 47 also, in the cavities 44, 44, force the permanent magnets 46, 46 from the backsides thereof toward the guide hole 40, and small disk-like plugs 48, 48 at the backsides of the coil springs are screwed into the peripheral walls of the cavities 44, 44. The coil springs 47, 47 force against the permanent magnets 46, 46, and since the cylindrical bodies 43, 43 are formed with the stoppers 45, 45 as described above, the permanent magnets 46, 46 are held between the coil springs 47, 47 and the stoppers 45, 45 with only portions of the spherical surfaces thereof projecting into the guide hole 40. The amount of the permanent magnets 46, 46 projecting into the guide hole 40 may be regulated by selecting, suitably, the opening diameter of the cylindrical bodies 43, 43 at the portions thereof formed with the stopper 45, 45. It is, however, preferable to select the projection to be about half of the difference between the diameter of the stem of the nail having the maximum diameter usable in automatic nailing machine according to the present invention and the diameter of the guide hole 40.

The nails 80, 81, 82 - - -, to be driven in the wood 90 are charged into the magazine 5 through the end opening on the side located above it so that the heads of the nails engage stepped protrusions 51*c*, 52*c*. The side plates 51, 52 which face each other to bring the stepped protrusions 51*c*, 52*c* inside are connected by the bolts 53 (which pass through the play holes 52*e*, and spring 54 from the side of side plate 52, and are screwed into the tapped holes 51*e*), and the connecting rods 55. The space between the main walls 51*b*, 52*b* of the side plates 51, 52 beneath the protrustions 51*c*, 52*c* is regulated by turning the bolts 53 to be slightly larger than the diameter of the stem of the desired nail to be driven into the wood 90.

Since the spring 54 is interposed between the upper walls 51*d*, 52*d*, the dimension of the space between the main walls 51*d*, 52*d* may be varied smoothly by turning the bolts 53. Also, the main walls 51*b*, 52*b* may be moved smoothly, while substantially maintaining the parallelism between them throughout the total length thereof, together with the movement of the upper walls 51*d*, 52*d* by using the spacer effect or pressing force of the small springs 56, 57 surrounding the connecting rods 55. If the side plates 51 and 52 were connected only by means of the bolt 53, there would be a possibility that the lower parts of the main walls 51*b*, 52*b* would come close to each other, and the smooth sliding of nails would be prevented. To prevent this, spring 56 acts to maintain a suitable space between the main walls 51*b* and 52*b*. The spring 57 on the other hand, establishes the distance between the lower part of the main wall 52*b* and the disk 55*b* and acts to prevent an excessive distance between both walls 51*b*, 52*b* due to the pressure of the spring 56. Therefore, the springs 56, 57 do not maintain a true parallelism of the walls 51*b*, 52*b* but they do act to maintain an approximate parallelism of the walls.

Figure 10:
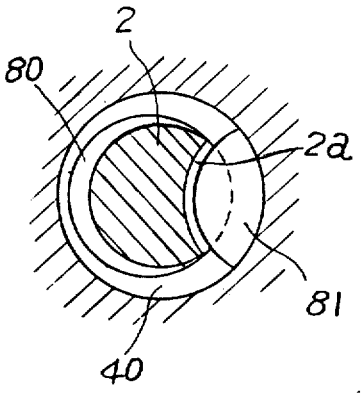
FIG. 10 is a sectional view of the piston rod along the line C—C in FIG. 2.
Figure 11:
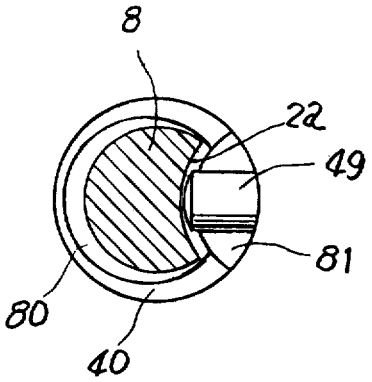
FIG. 11 is a sectional view of the piston rod along the line D—D in FIG. 2.

The magazine 5 is inclined downward to the side of the guide hole 40, and the dimension of the space between the side plates 51, 52 is regulated as described above, so that the nails 80, 81, 82, - - - slide downward toward the guide hole 40 still maintaining a parallel order. The foremost nail 80 is transferred into the guide hole 40 from the end opening of the magazine 5 and is simultaneously attracted to the permanent magnets 46, 46. The lower surface of the head of the nail 81 adjacent the nail 80 contacts and engages the upper surface of the nail 80, but the entering of the nail 81 into the guide hole 40 is interrupted and only the nail 80 is driven downward into the wood 90 by the impact of the piston rod 2. As shown in FIGS. 10 and 11, the piston rod 2 has a cross-section shaped something like a fat crescent. The crescent part or a groove 2*a* is formed along the side surface which faces the open end of magazine 5. Therefore, when the piston rod 2 is moved downward, only one nail 80 is driven at a time, and the adjacent nail 81 is not driven due to the existence of the groove 2*a*. In other words, the plane position of the groove 2*a* corresponds with the portion of the head of the nail 81 which projects into the guide hole 40.

The front edge of a guide pin 49 and the groove 2*a* engage each other with a small gap so that the piston rod 2 can move downwardly smoothly. The guide pin 49 prevents the revolution of the piston rod 2 and also secures the relative positional relation between the groove 2*a* and the head of the adjacent nail 81 to prevent the driving of the nail 81 when the nail 80 is driven.

When the trigger 6 secured to the base portion of the handle 3 is pulled, compressed air is supplied to the driving device (not shown) of the piston rod 2 housed in the casing 1, and thus moves the piston rod 2 downward to strike against the head of the nail 80. By this impact, the nail 80 moves downward, but since the permanent magnets 46, 46 are spherical, and contact against the stem of the nail 80 while turning round, the downward movement described above is carried out very smoothly.

When the head of the nail 80 and the tip of the piston rod 2 reach the permanent magnets 46, 46, the permanent magnets 46, 46 are pressed by them, move toward the plugs 48, 48 and retract into the spaces 44, 44 (illustrated with imaginary line), so that the downward movement of the nail 80 and the piston rod 2 is not interrupted. After the tip of the piston rod 2 reaches the tip of the nose 4, the nailing is completed, and the trigger 6 is released, the piston rod 2 returns upward by means of a spring mechanism (not shown) provided within the casing or a reverse drive of compressed air. Since the permanent magnets 46, 46 are pressed by the coil springs 47, 47, after the tip of the piston rod 2 passes the permanent magnets 46, 46, the magnets return to project again a portion of their spherical surfaces into the guide hole 40. At the time of the piston rod 2 is in position above the head of the foremost nail 81 waiting for movement into the guide hole 40 within the casing, the nail 81 drops by its own weight into the guide hole 40 and is simultaneously attracted and held by the permanent magnets 46, 46, while its head interrupts the movement of the nail 82 into the guide hole 40.

The automatic nailing machine according to the present invention is to drive the nails 80, 81, 82, - - - by repeating the operation as described above. As is apparent from the above description, in the automatic nailing machine, the nose 4 which may supply nails one by one is very simple in construction, so that the machine is not only very durable and cheaply manufactured, but it also may utilize loose nails, thereby maintaining very low operating costs. Further, since the magazine is constructed so that the dimension of the space between the two side plates 51, 52 may be regulated at will up to a nail size which is determined by the diameter of the guide hole 40, when the dimension of the space is regulated suitably to accommodate the diameter of the nail and the nails are charged in the magazine 5, the nails will slide down smoothly toward the guide hole 40 without stopping half-way in the magazine.

Further, as modified embodiments of the present invention, there are structures which will demonstrate the same effect as the embodiment described above. These structures, instead of having the spherical permanent magnet may use a columnar magnet having a spherical end projecting into the guide hole 40, or without providing any magnetic attracting means such as spherical or columnar permanent magnet or the like in the side wall 41 of the guide hole 40, these modified structures may provide magnetic attracting means such as permanent magnet at the tip of the piston rod positioned slightly above the connecting portion of the magazine 5 and the guide hole 40 when the piston is fully returned.

Figure 12:
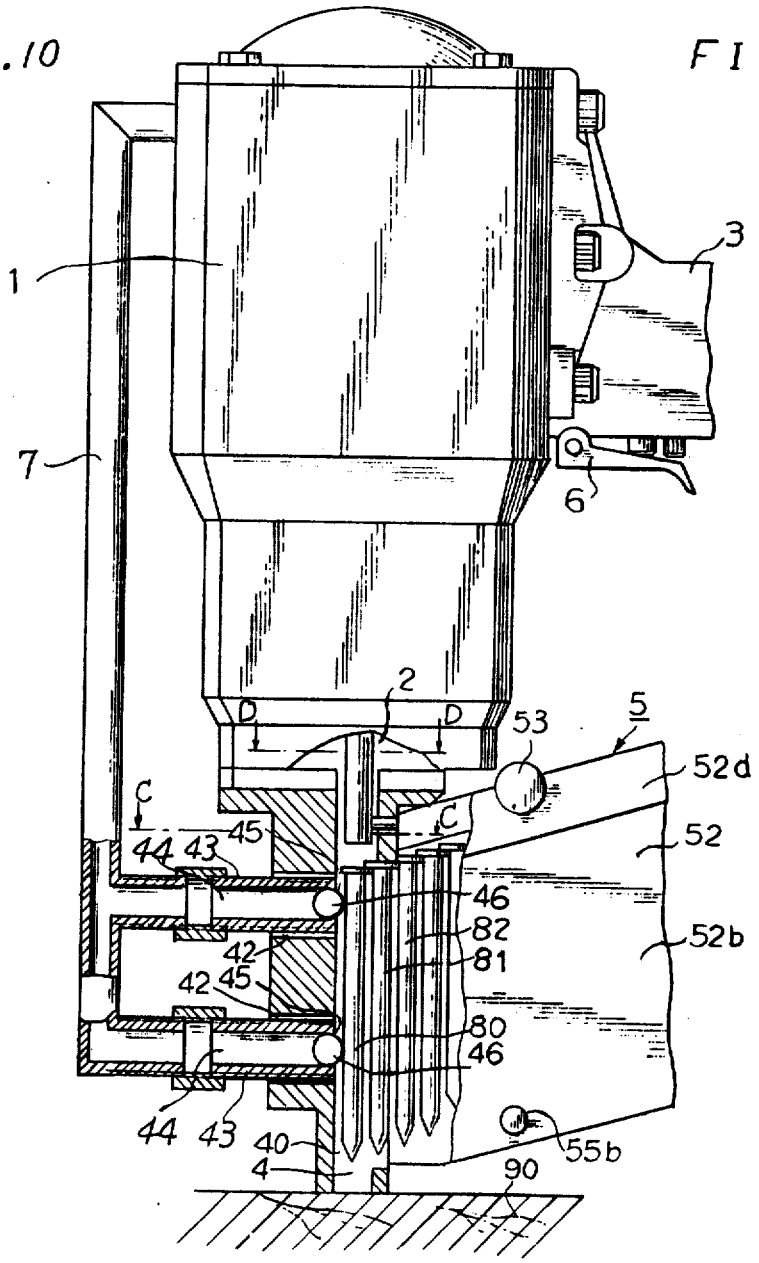
FIG. 12 is an alternative embodiment of the present invention.

It is also possible to utilize in the embodiments described above compressed air instead of the coil springs 47, 47 as the means for forcing the permanent magnets 46, 46 toward the guide hole 40. FIG. 12 shows this embodiment using compressed air in lieu of springs 47, 47. In the casing 1, there exists a space, where compressed air is always supplied whether the trigger 6 is pulled or not, like most conventional nailing machines. The illustrated connecting pipe 7 connects this space (not illustrated) and the spaces 44, 44 of the cylindrical bodies 43, 43, and leads the compressed air to the spaces 44, 44 to push forward the permanent magnets 46, 46.

Finally, as for connecting means for the side plates 51, 52, the dimension of the space between which is variable, it is a metter of course that any suitable conventional known connecting means may be utilized besides the combination of the bolt 53 and the spring 54 as described above.

What is claimed is:

1. In an automatic nail driving device having a guide hole through which the nail to be driven is driven, a reciprocal compressed air piston rod means at the top of said guide hole above said nail for driving said nail downward, and a magazine means at the side of said guide hole for supplying nails to said guide hole, the improvement comprising:

a magnetic attraction means positioned on the side of said guide hole opposite said magazine at a right angle to said guide hole and resiliently projecting into said guide hole for attracting said nails in said magazine, said attraction means comprised of:

at least one cylindrical member fitted through the wall of said guide hole opposite said magazine at a right angle to said guide hole and having an opening into said guide hole, a spherical permanent magnet in said cylindrical member at the end thereof open into said guide hole, and biasing means within said cylindrical member against said permanent magnet for resiliently forcing said magnet toward said guide hole.

2. An improved automatic nailing device as claimed in claim 1, further comprising an improved magazine means for supplying nails to said guide hole, said improved magazine means comprised of:

two spaced side plates having stepped protrusions at the top side thereof for engaging said nails beneath the heads thereof, one of said side plates having at the upper end thereof above said stepped protrusion thereon at least one tapped hole therethrough and the other of said side plates having at least one play hole therethrough above said stepped protrusion opposite said tapped hole, said side plates further having a plurality of small holes opposite each other therethrough at the lower sides thereof;

a first spring fitted between and forcing apart the upper ends of said side plates between said tapped hole and said play hole;

a bolt fitted through said play hole and threaded into said tapped hole, whereby tightening said bolt forces said side plates closer together against the force of said spring and brings said stepped protrusions closer together;

a plurality of second springs between the lower insides of said plates between said plurality of opposing small holes;

a plurality of connecting rods fitted through said small holes at the lower side of said side plates and said second springs, said connecting rods having a disc on each end thereof outside of said side plates; and a plurality of third springs surrounding said connecting rods on the outside of one of said side plates between said side plate and said disc at the end of said connecting rod.

* * * * *